US006377290B1

(12) United States Patent
Amiya et al.

(10) Patent No.: US 6,377,290 B1
(45) Date of Patent: Apr. 23, 2002

(54) THERMAL PRINTER APPARATUS

(75) Inventors: Isao Amiya; Hiroshi Ootani, both of Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/455,983

(22) Filed: Dec. 6, 1999

(30) Foreign Application Priority Data

Dec. 21, 1998 (JP) ..... 10-363225

(51) Int. Cl.[7] ..... B41J 2/36
(52) U.S. Cl. ..... 347/194
(58) Field of Search ..... 347/211, 194, 347/192, 195; 358/410; 400/120.14, 120.16

(56) References Cited

U.S. PATENT DOCUMENTS 5,629,730 A * 5/1997 Park ..... 347/188
5,841,461 A * 11/1998 Katsuma ..... 347/195
5,874,982 A * 2/1999 Ueda et al. ..... 347/194

FOREIGN PATENT DOCUMENTS

JP 63173665 7/1988
JP 63218376 9/1988
JP 63295278 12/1988
JP 64-50945 3/1989
JP 02029352 1/1990
JP 2310061 12/1990

* cited by examiner

*Primary Examiner*—N. Le
*Assistant Examiner*—K. Feggins
(74) *Attorney, Agent, or Firm*—Adams & Wilks

(57) ABSTRACT

A thermal printer apparatus has a configuration which avoids adverse influences caused by a voltage variation and a change in printing speed so that superior printing quality is obtained. A temperature of a thermal head is measured based on an output signal of a thermistor contained in the thermal head, and a voltage applied to the thermal head is measured by a thermal head voltage detecting circuit. A CPU calculates a maximum energizing pulse width based upon the measured temperature and head-applied voltage, a main pulse width based on the maximum energizing pulse width and a printing speed, and a preselected ratio of a sub-pulse width with respect to the maximum energizing pulse width in response to a drive history. The CPU supplies the energizing pulse to the thermal head and the energizing pulse has a width set as the smaller of the sum of the pulse widths of the main pulse and the sub-pulse, and the maximum energizing pulse width.

29 Claims, 4 Drawing Sheets

THERMAL PRINTER APPARATUS

BACKGROUND OF THE INVENTION

1. Field of the Invention

The present invention generally relates to a thermal printer apparatus equipped with a plurality of heating elements arranged on a thermal printing head and capable of printing out on print paper by supplying energizing pulses to these heating elements in response to a print signal. More specifically, the present invention is directed to such a thermal printer apparatus capable of eliminating voltage variations and printing speed changes with employment of a simple structure.

2. Description of the Related Art

Conventionally, thermal printer apparatuses equipped with a plurality of heating elements arranged on thermal heads are utilized to print out characters and the like in such a manner that a printing operation is carried out on a print paper in a direct thermal manner, or a thermal transfer manner by applying energizing pulses to these heating elements in response to printing signals.

In general, such a thermal printer apparatus has a specific characteristic that remaining heat produced when these heating elements are energized may influence printing density. As a result, in order to keep the printing density constant, the conventional thermal printer apparatuses employ an historical controlling system. That is, in this historical controlling system, the energizing pulses are applied to the respective heating elements, while considering the drive histories of the respective heating elements.

For example, in the thermal printer apparatus described in Japanese Registered Patent No. 2681004, the energizing pulse width of the driven dot of interest is controlled by considering the voltage application time, the formula, and the drive histories of 4 sets of dots located near the above-described driven dot of interest. This voltage application time is defined based upon the peripheral temperature of the thermal head. The formula is determined by the printing cycle time and the like.

Furthermore, in the thermal printer apparatus disclosed in Japanese Registered Patent No. 2647062, the energizing time of the dot of interest is subdivided into the main energizing time and the sub-energizing time. The summation between the main energizing time and the sub-energizing time is determined based upon the peripheral temperature of the thermal head. Then, both the main energizing time and the sub-energizing time corresponding to the printing conditions acquired until 2 previous printing cycles have been accomplished are determined by the ratio fixed by the printing mode. As a consequence, the dot of interest is energized based upon these determined factors.

On the other hand, the thermal printer apparatus described in Japanese Registered Patent No. 2681004 has the problem that since the energizing pulse is determined based on both the peripheral temperature of the thermal head and also the printing cycle time, this energizing pulse cannot follow the variations contained in the voltages applied to the thermal head. Also, since a complex calculation must be carried out in order to produce the historical data, this thermal printer apparatus has another problem in that high speed calculating apparatus is necessarily employed, resulting in very expensive thermal printer apparatus.

Also, in the thermal printer apparatus described in Japanese Registered Patent No. 2647062, the summation between the main-energizing time and sub-energizing time is determined based only upon the peripheral temperature of the thermal head. Similar to the first-mentioned thermal printer apparatus, this thermal printer apparatus has the problem that the energizing pulse cannot follow the voltage variations. Furthermore, both the main energizing time and the sub-energizing time are subdivided by the ratio determined by the printing mode in this thermal printer apparatus. As the result, there is a further problem that this energizing pulse cannot follow a change in the printing speeds. In addition, since a specific gate circuit capable of outputting the sub-energizing pulse is required, the structure of this thermal printer apparatus becomes very complex, and eventually, this thermal printer apparatus is made very expensive.

SUMMARY OF THE INVENTION

The present invention has been made to solve the above-described various problems of the prior art printers, and therefore, an object of the invention is to provide a thermal printer apparatus having a simple arrangement, capable of achieving a sufficiently high printing quality, while suppressing adverse influences caused by a voltage variation and a change in printing speeds.

To achieve the above-described object, a thermal printer apparatus, according to the present invention, is characterized in that the thermal printer apparatus is equipped with a plurality of heating elements arranged on a thermal head, and an energizing pulse responding to a printing signal is applied to the respective heating elements so as to energize the heating elements, whereby a printing operation is performed on a print paper, the thermal printer apparatus comprising: temperature measuring means for measuring a temperature of the thermal head; voltage measuring means for measuring a voltage applied to the thermal head; and head drive means for calculating a maximum energizing pulse width based upon the measured temperature of the thermal head and the applied voltage thereto, for calculating a main pulse width based on both the maximum energizing pulse width and a printing speed, for calculating a preselected ratio of a sub-pulse width with respect to the maximum energizing pulse width, and for outputting to the thermal head, such an energizing pulse having a smaller pulse width selected from a summed width between the main pulse width and the sub-pulse width, and also the maximum energizing pulse so as to drive the thermal head.

In this thermal printer apparatus, the temperature measuring means measures the temperature of the thermal head, and the voltage measuring means measures the voltage applied to the thermal head. The head drive means calculates the maximum energizing pulse width based upon the measured temperature of the thermal head and the applied voltage thereto, calculates the main pulse width based on both the maximum energizing pulse width and the printing speed, calculates the preselected ratio of the sub-pulse width with respect to the maximum energizing pulse width, and outputs to the thermal head, such an energizing pulse having the smaller pulse width selected from the summed width between the main pulse width and the sub-pulse width, and also the maximum energizing pulse so as to drive the thermal head.

Also, the above-described head drive means includes maximum energizing pulse width calculating means for calculating the maximum energizing pulse width based upon both the measured temperature of the thermal head and the applied voltage; energizing pulse width calculating means for calculating the main pulse width based on both the maximum energizing pulse width and the printing speed, and also for calculating the preselected ratio of the sub-pulse width with respect to the maximum energizing pulse; and output means for outputting to the thermal head, such an energizing pulse having the smaller pulse width selected from the summed width between the main pulse width and the sub-pulse width, and also the maximum energizing pulse.

Also, the above-explained energizing pulse width calculating means may be arranged to calculate the sub-pulse width by multiplying the maximum energizing pulse width by a predetermined coefficient "K".

Further, the above-mentioned coefficient "K" may be selected from a value within a range between 0.1 and 0.3.

Furthermore, the thermal printer apparatus may be arranged in such a manner that the sub-pulse is not applied to the heating elements which are energized at the prestage, and further are presently energized.

BRIEF DESCRIPTION OF THE DRAWINGS

For a better understanding of the present invention, reference is made of a detailed description to be read in conjunction with the accompanying drawings, in which.

DETAILED DESCRIPTION OF THE PREFERRED EMBODIMENTS

Referring now to the attached drawings, various preferred embodiments of the present invention will be explained.

Arrangement of Thermal Printer Apparatus

Figure 1:
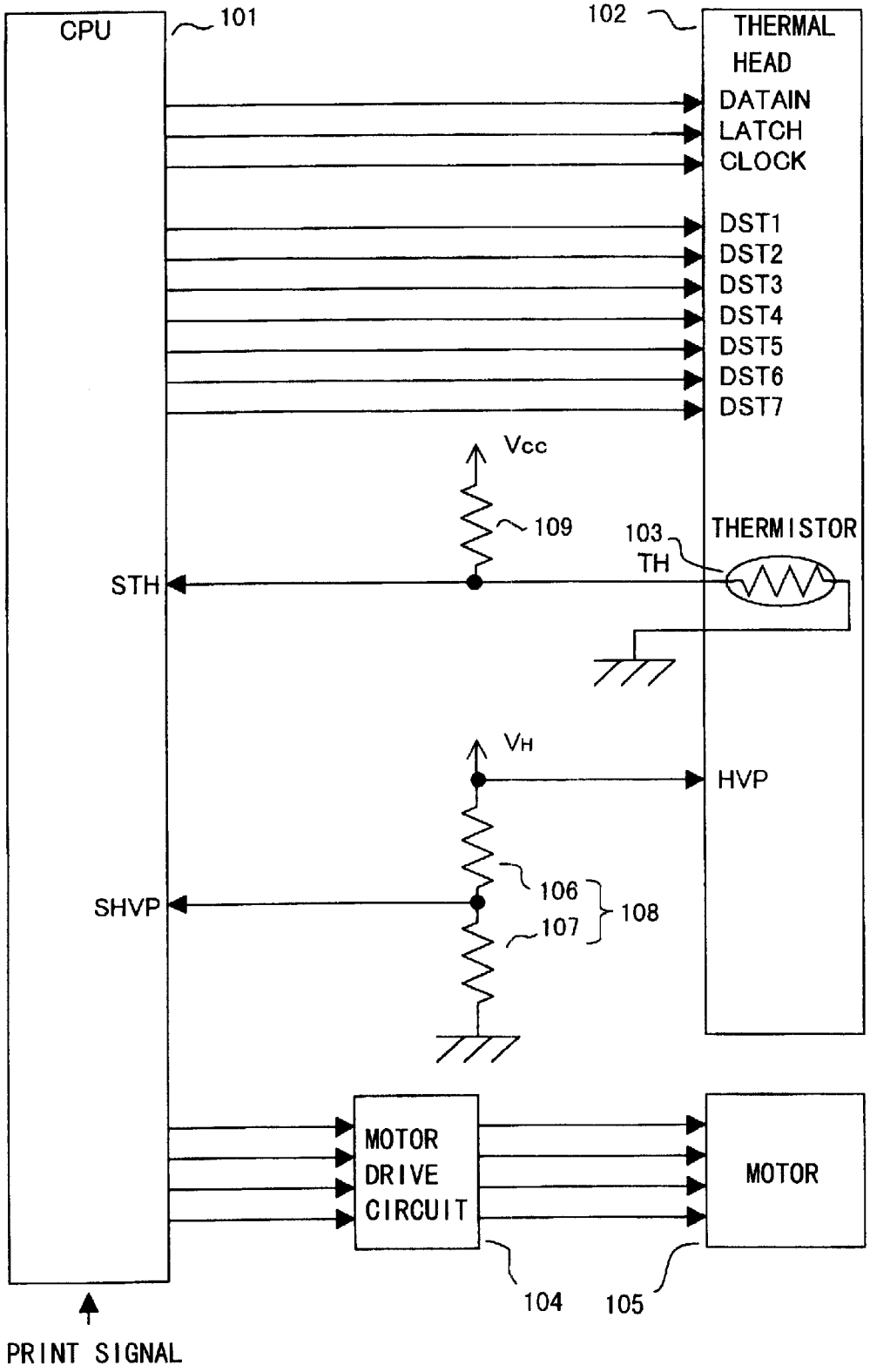
FIG. 1 is a schematic block diagram of a thermal printer apparatus according to an embodiment of the present invention.

FIG. 1 schematically represents an arrangement of a thermal printer apparatus according to an embodiment of the present invention.

In FIG. 1, the thermal printer apparatus according to this embodiment is arranged by a central processing unit (CPU) 101 for constituting a head driving means into which a print signal, for example, print data is entered; a thermal head unit 102; a motor 105 for controlling a print paper feeding operation; a motor drive circuit 104 for driving the motor 105; and a head voltage detecting circuit 108. This head voltage detecting circuit 108 is formed by resistors 106 and 107 series-connected to each other, and constitutes a voltage measuring means for measuring a voltage "VH" applied to a thermal head of the thermal head unit 102. Also, this thermal head unit 102 includes a thermistor 103 that consititutes a temperature measuring means for measuring a temperature of the thermal head.

On the other hand, both a terminal STH of the CPU 101 and a terminal TH of the thermal head unit 102 are connected via another resistor 109 to a power supply VCC. The thermistor 103 is connected to the terminal TH of the thermal head unit 102. As a result, a voltage produced by subdividing the voltage of the power supply VCC by using this thermistor 103 and the resistor 109 may be entered to the terminal STH of the CPU 101. In other words, a signal indicative of a temperature of the thermal head is entered to the terminal STH of the CPU 101.

Also, the voltage VH applied to the thermal head is entered to a terminal HVP of the thermal head unit 102. Also, the signal indicative of this head-applied voltage VH is entered to the head voltage detecting unit 108.

Figure 2:
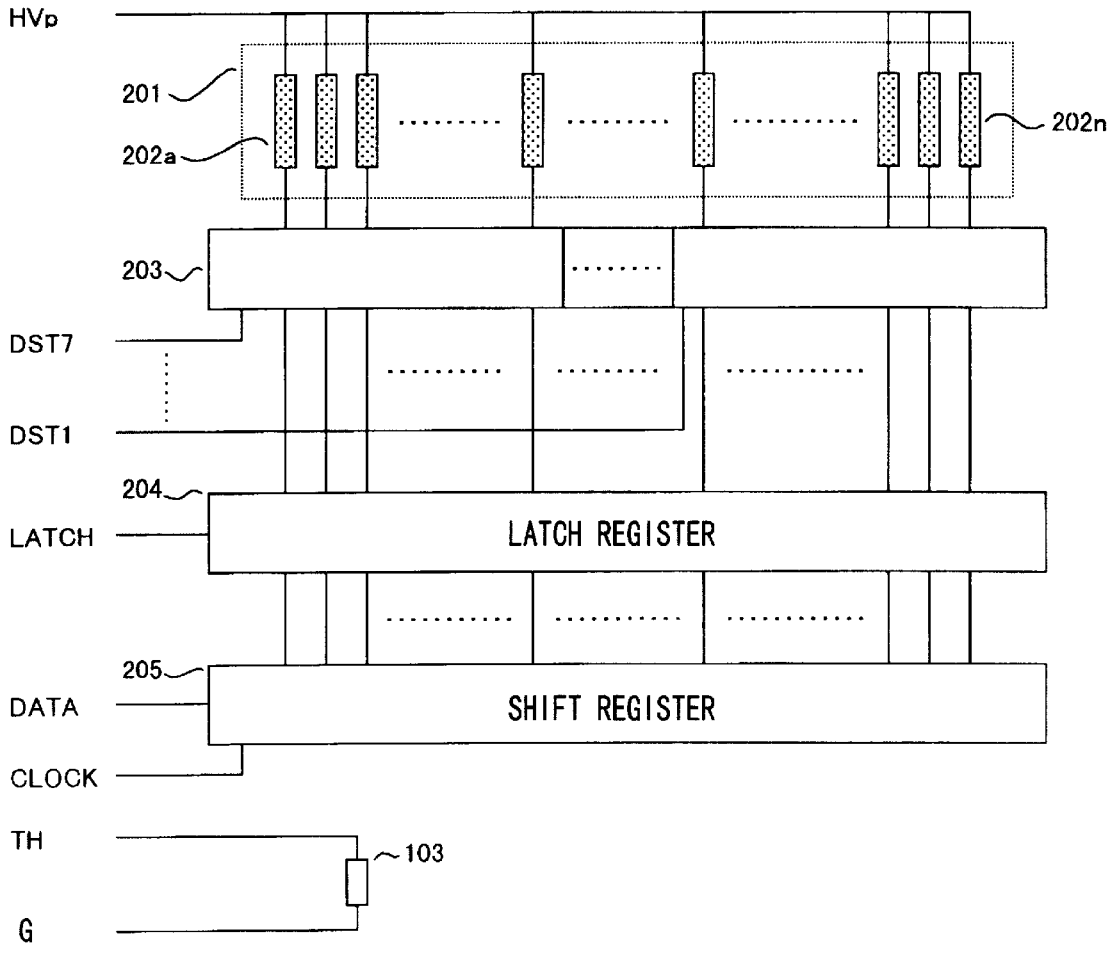
FIG. 2 is a schematic block diagram of a thermal head unit employed in the thermal printer apparatus according to the embodiment of the present invention.

FIG. 2 is a block diagram for showing a detailed structure of the above-explained thermal head unit 102. The thermal head unit 102 is provided with a shift register 205, a latch register 204, an output driver 203, a thermal head 201, and the thermistor 103 for measuring a temperature of the thermal head 201. In synchronism with a clock signal "CLOCK", print data "DATA" are sequentially entered from the CPU 101 into this shift register 205. The print data registered in this shift register 205 is latched by the latch register 204 in response to a latch signal LATCH. The output driver 203 is subdivided into a plurality of blocks. In response to strobe signals DST1 to DST7, this output driver 203 outputs an energizing pulse in the unit of a block. This energizing pulse is produced in correspondence with a signal derived from the latch register 204. The thermal head 201 contains a plurality of heating elements 202*a* to 202*n* used to print out on a print paper. This thermal head 201 is driven by the energizing pulse supplied from the output driver 203 to be accordingly heated.

It should be noted that the heating elements 202*a* to 202*n* are constructed of 448 elements, and the output driver 203 is subdivided into 7 blocks, in which a single block is formed of 64 heating elements. Also, along with the CPU 101 the output driver 203, the latch register 204, and the shift register 205 constitute the head drive means.

Printing Operation of Thermal Printer Apparatus

Figure 3:
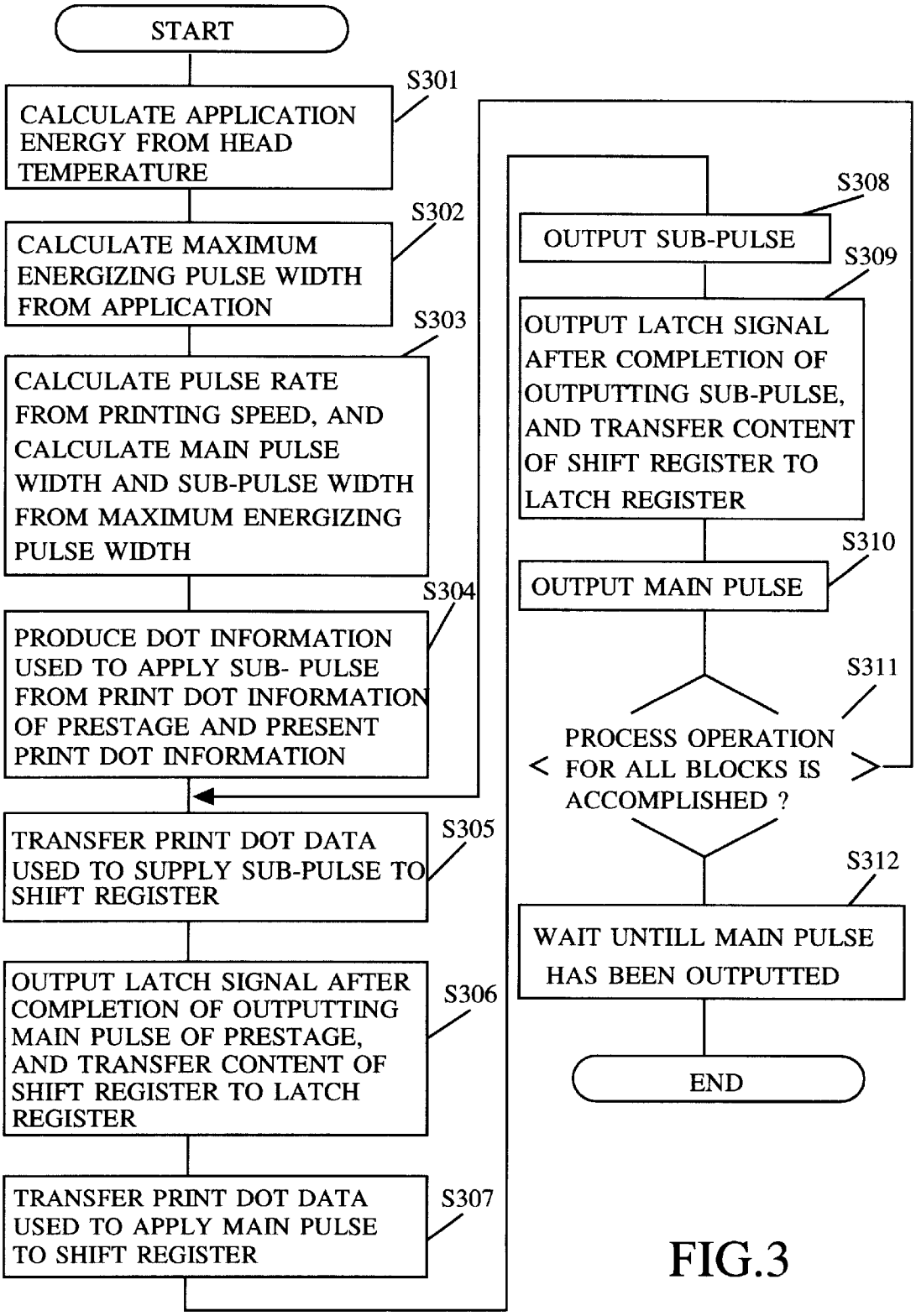
FIG. 3 is a flow chart explaining printing operation of the thermal printer apparatus shown in FIG. 1.
Figure 4:
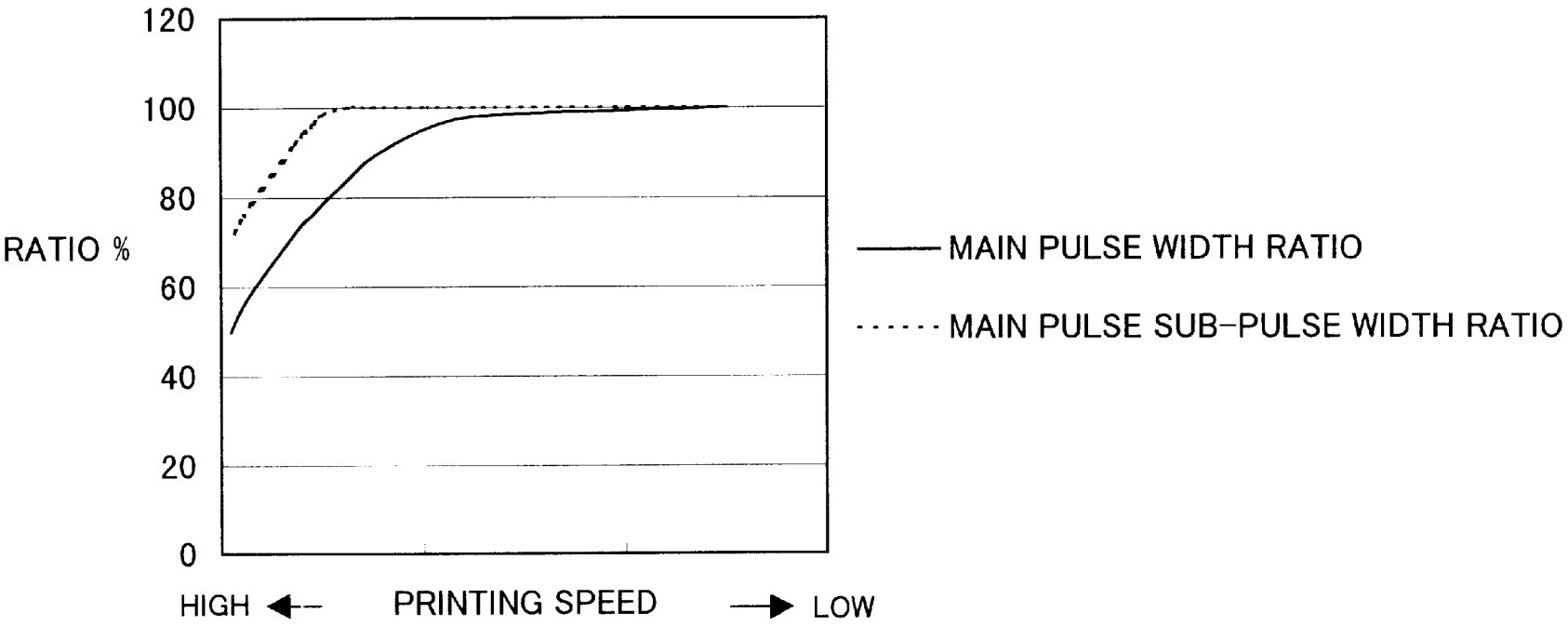
FIG. 4 is a characteristic diagram representing a relationship between a printing speed and an energizing pulse width of the thermal printer apparatus indicated in FIG. 1.

FIG. 3 is a flow chart illustrating process operations executed by the CPU 101. FIG. 4 is a characteristic diagram illustrating a relationship between a printing speed and the above-explained energizing pulse.

Referring now to FIG. 1 to FIG. 4, a printing operation of the thermal printer apparatus will be described.

At a first step S301 of the flow chart shown in FIG. 3, the CPU 101 calculates an application energy to be applied to the thermal head 201 based upon a head temperature of the thermal head 201 measured by using the thermistor 103.

Subsequently, the CPU 101 calculates a maximum energizing pulse width "T" based on both the above-explained application energy and a head-application voltage applied to the thermal head 201 at a step S302. The head-application voltage is measured with the head voltage detecting circuit 108. The maximum energizing pulse width "T" corresponds to a maximum pulse width of such an energizing pulse capable of energizing the respective heating elements 202*a* to 202*n*.

It should also be noted that a means for performing the process operations defined at the previous steps S301 and S302 constitutes a maximum energizing pulse width calculating means.

Next, the CPU 101 calculates a pulse rate based upon a printing speed, and further calculates both a main pulse width and a sub-pulse width from the above-calculated maximum energizing pulse width "T" at a step S303. Also, a means for executing the process operation defined at this step S303 constitutes an energizing pulse width calculating means.

For instance, assuming now that a printing period is expressed as W msec and is obtained from an inverse number of a printing speed, a pulse width "TM" of a main pulse is set to such a value capable of satisfying the below-mentioned formula (2) by using a pulse rate "C" determined by the following formula (1):

$$C=1-2.8/(3.3+W) \quad (1),$$

$$TM=T*C \quad (2).$$

Also, as a pulse width "TS" of a sub-pulse, a selection is made of any smaller one of the below-mentioned values capable of satisfying:

$$TS=T*K \quad (3), \text{ and}$$

$$TS=T*(1-C) \quad (4).$$

In other words, the width TS of the sub-pulse is determined in such a way that a total width of the main pulse width TM and the sub-pulse width TS does not exceed the above-explained maximum energizing pulse width. It should be noted that both the pulse rate C defined in the above formula (1) and the pulse rate K defined in the above formula (3) are obtained from the experimental operation. It is possible to print out with small fluctuations in print density by setting that this pulse rate K is limited to a range between 0.1 and 0.3. More specifically, when the printing speed is selected to be lower than, or equal to approximately 150 mm/sec, superior printing quality could be obtained.

FIG. 4 represents a relationship among the main pulse width "TM", the sub-pulse width "TS", and the printing speed. A rate 100% indicates a maximum energizing pulse width.

When the printing speed is increased, the remaining heat of the respective heating elements 202*a* to 202*n* must be considered. As a consequence, when the printing speed is higher than or equal to a preselected printing speed, the widths of the energizing pulses applied to the respective heating elements 202*a* to 202*n* are shortened, whereas when the printing speed is lower than or equal to the preselected printing speed, energizing pulses having the maximum energizing pulse widths are applied to the respective heating elements 202*a* to 202*n*.

Next, considering such a fact that a drive history of a prestage may give the largest influence to the printing quality, the CPU 101 produces dot information used to apply the sub-pulse from both the print dot information of the prestage and the present print dot information (step S304), and then transfers print dot data used to apply the sub-pulse to the shift register 205 (step S305).

Next, after the main pulse of the prestage has been outputted, the CPU 101 supplies the latch signal to the latch register 204 so as to transfer the content of the shift register 205 to the latch register 204 (step S306).

Next, the CPU 101 transfers print dot data used to apply a main pulse to the shift register 205 at a step S307.

Thereafter, the sub-pulse is output from the latch register 204 to the output driver 203, and such an energizing pulse having a width corresponding to the sub-pulse is output from this output driver 203 to the heating elements 202*a* to 202*n* at a step S308. It should be noted that no such sub-pulse is applied to the heating elements 202*a* to 202*n* that are energized at the prestage and furthermore are presently energized.

After the above-described sub-pulse has been completely outputted, the CPU 101 outputs a latch signal to the latch register 204, and transfers the content of the shift register 205 to the latch register 204 (step S309), and then outputs a main pulse via the output driver 203 of the above-described block from the latch register 204 (step S310).

For instance, in the case that the printing dot data at the prestage is "D0" and the present printing dot data is "D1", such a signal produced by AND-gating D1 and a signal inverted from D0 is transferred as sub-pulse data to the shift register 205 and then latched in the latch register 204. Next, D1 is transferred to the shift register 205, and thereafter, the sub-pulse is applied to the thermal head 201. Subsequently, D1 is latched to the latch register 204, and then is output as the main pulse to the thermal head 201. As a result, the sub-pulse may be applied to such heating elements 202*a* to 202*n* that are not energized at the prestage, but are presently energized. However, no sub-pulse is applied to those heating elements 202*a* to 202*n* that are energized at the prestage and also are presently energized.

A series of the above-explained process operations is carried out in the unit of either 1 block or several blocks. The CPU 101 checks as to whether or not the process operations for all of these blocks is accomplished at a step S311. When such a process operation is not yet accomplished, the process operation is returned to the previous step S305. Then, a series of the above-explained process operations is repeatedly performed. To the contrary, when the process operation is completed as to all of these blocks, the CPU 101 is brought into a waiting state until the main pulse has been outputted. When the main pulse has been outputted, this process operation is ended at a step S312.

In this case, the means for executing the process operations defined at the steps S304 to S312, the output driver 203, the latch register 204, and the shift register 205 constitute the output means.

As previously described in detail, the thermal printer apparatus according to this embodiment of the present invention is featured as follows:

In such a thermal printer apparatus equipped with a plurality of heating elements 202*a* to 202*n* arranged on the thermal head 201, in which the energizing pulse responding to the printing signal is applied to the respective heating elements 202*a* to 202*n* so as to energize these heating elements 202*a* to 202*n*, whereby the printing operation is made on the print paper, this thermal printer apparatus is featured by comprising the thermistor 103 for measuring the temperature of the thermal head 201; the head voltage detecting circuit 108 for measuring the voltage applied to the thermal head 201; and the CPU 101 and the like for calculating the head-applied energy from the temperature of the thermal head 201, for calculating the maximum energizing pulse width from the calculated head-applied energy and the head-application voltage, for calculating the main pulse width based upon the maximum energizing pulse width and the printing speeds, and for calculating the sub-pulse width obtained by multiplying the maximum energizing pulse width by a preselected coefficient "K" in response to the drive history, and further for calculating the energizing pulse width having the summed width between the main pulse width and the sub-pulse width. The CPU 101 and the like outputs to the thermal head 201, such an energizing pulse having the smaller pulse width selected from the summed width between the main pulse width and the sub-pulse width, and also the maximum energizing pulse so as to drive the thermal head 201. As a result, this thermal printer apparatus can achieve the sufficiently high printing quality while suppressing the adverse influences caused by the voltage variation. Also, the variation in the print density caused by a change in the printing speeds can be suppressed.

Furthermore, since this thermal printer apparatus can be realized by employing the hardware structure similar to that of the conventional thermal printer apparatus, the entire arrangement thereof can be made simple.

The above-explained coefficient "K" is preferably selected to be such a value within a range between 0.1 and 0.3 in accordance with the experiment. Also, in this thermal printer apparatus, the printing qualities can be improved over the wide printing speed range. In the case that the printing speed is lower than, or equal to approximately 150 mm/sec, the largest influence caused by the drive history of the prestage is made and thus, the superior printing quality can be achieved.

As previously explained in detail, the thermal printer apparatus, according to the present invention, can realize the sufficiently high printing qualities by employing the simple arrangement, while suppressing the adverse influences caused by the voltage variations. Also, this thermal printer apparatus can suppress the variations in the printing density caused by a change in the printing speeds.

What is claimed is:

1. In a thermal printer apparatus having a plurality of heating elements arranged in a thermal head, in which an energizing pulse is applied to the respective heating elements in accordance with a printing signal to energize the heating elements to perform a printing operation by printing on a print paper, the thermal printer apparatus comprising:

temperature measuring means for measuring a temperature of the thermal head;

voltage measuring means for measuring a voltage applied to the thermal head; and head drive means for calculating a maximum energizing pulse width T based upon the measured temperature of the thermal head and the measured voltage applied thereto, for calculating a main pulse width TM based on the maximum energizing pulse width T and a printing speed W, for calculating a sub-pulse width TS as a preselected ratio of the maximum energizing pulse width TM, and for outputting to the thermal head for the printing of one dot on a current line an energizing pulse for driving the thermal head, the energizing pulse having a pulse width selected as the smaller one of a summed pulse width of each of an energizing pulse having the calculated sub-pulse width and comprising an energizing pulse corresponding to print dot data for the current line prepared from a logical multiplication of inverted print dot data of a preceding line, and an energizing pulse having the calculated main pulse width TM and comprising an energizing pulse corresponding to print dot data of the current line and, the pulse width of the maximum energizing pulse T.

2. A thermal printer apparatus according to claim 1; wherein the head drive means comprises maximum energizing pulse width calculating means for calculating the maximum energizing pulse width T based upon the measured temperature of the thermal head and the measured voltage applied thereto; energizing pulse width calculating means for calculating the main pulse width TM based on the maximum energizing pulse width T and the printing speed W and for calculating the sub-pulse width TS as the preselected ratio of the maximum energizing pulse; and output means for outputting to the thermal head the energizing pulse for driving the thermal head for the printing of one dot on the current line and having the pulse width selected as the smaller one of the summed pulse width of each of an energizing pulse having the calculated sub-pulse width and comprising an energizing pulse corresponding to print dot data for the current line prepared from a logical multiplication of inverted print dot data of the preceding line, and an energizing pulse having the calculated main pulse width TM and comprising an energizing pulse corresponding to print dot data of the current line, and the pulse width of the maximum energizing pulse T.

3. A thermal printer apparatus according to claim 2; wherein the energizing pulse width calculating means includes means for calculating the sub-pulse width TS by multiplying the maximum energizing pulse width T by a predetermined coefficient "K".

4. A thermal printer apparatus as claimed in claim 3; wherein the coefficient "K" is selected as a value within the range of 0.1 and 0.3.

5. A thermal printer apparatus as claimed in any one of claims 1, 2, 3, or 4; wherein the sub-pulse is not applied to the heating elements which are to be energized in the current line and which were energized in the preceding line.

6. A thermal printer apparatus according to claim 1; wherein the temperature measuring means comprises a thermistor for producing an output voltage according to the temperature of the thermal head and processing means for calculating the temperature of the thermal head in accordance with the output voltage of the thermistor; and the voltage measuring means comprises a voltage dividing circuit for producing a divided voltage having a value depending upon a voltage applied to the thermal head and processing means for determining the voltage applied to the thermal head in accordance with the divided voltage.

7. A thermal printer apparatus according to claim 1; wherein the thermal head further comprises a shift register for storing print data; a latch register for latching the print data from the shift register; and an output driver for driving the heating elements by producing the energizing pulses in accordance with the print data.

8. A thermal printer apparatus according to claim 1; wherein the thermal head contains 448 heating elements.

9. A thermal printer apparatus according to claim 1; wherein the main pulse width TM is determined in accordance with the following equations:

$$C=1-2.8/(3.3+W); \text{ and}$$

$$TM=T*C$$

wherein C is a pulse rate.

10. A thermal printer apparatus according to claim 9; wherein the sub-pulse width TS is determined as the smaller value determined by the following equations:

$$TS=T*K; \text{ and}$$

$$TS=T*(1-C)$$

wherein K is a value set within the range of 0.1 to 0.3, and the sub-pulse width TS is set such that a total pulse width of the main pulse TM and the sub-pulse TS does not exceed the maximum energizing pulse width T.

11. A printer having a thermal head, comprising: a plurality of heating elements arranged in the thermal head for printing on a printing paper in response to energizing pulses; a temperature measuring circuit disposed in thermal head for measuring the temperature thereof; and driving means for driving the thermal head by producing the energizing pulses; wherein the driving means includes means for calculating a maximum pulse width T of an energizing pulse that may be applied to the heating elements based upon the temperature of the thermal head and a voltage applied thereto, calculating a pulse rate C based upon a printing speed W, calculating a main pulse width TM and a sub-pulse width TS based on the maximum energizing pulse width T, and outputting an energizing pulse for driving the thermal head based on the calculated main pulse width and sub-pulse width.

12. A thermal printer according to claim 11; wherein an energizing pulse for driving the thermal head has a pulse width set as the smaller one of a summed pulse width of the main pulse width TM and the sub-pulse width TS and the pulse width of the maximum energizing pulse T.

13. A thermal printer according to claim 11; wherein the driving means includes means for calculating the sub-pulse width by multiplying the maximum energizing pulse width by a preselected value K determined by experiment.

14. A thermal printer according to claim 13; wherein the preselected value is within the range of 0.1 and 0.3.

15. A thermal printer according to claim 11; wherein the sub-pulse is not applied to heating elements which are to be energized during a current application of a main pulse to the thermal head and which were energized during the application of a main pulse to the thermal head immediately preceding the current application.

16. A thermal printer according to claim 11; wherein the temperature measuring circuit comprises a thermistor for producing an output voltage according to the temperature of the thermal head and a processor for calculating the temperature of the thermal head in accordance with the output voltage of the thermistor; and further comprising a voltage measuring circuit for producing a divided voltage having a value depending upon a voltage applied to the thermal head and a processor for determining the voltage applied to the thermal head in accordance with the divided voltage.

17. A thermal printer according to claim 11; wherein the thermal head further comprises a shift register for storing print data; a latch register for latching the print data from the shift register; and an output driver for driving the heating elements by producing energizing pulses in accordance with the print data.

18. A thermal printer apparatus according to claim 11; wherein the main pulse width TM is determined in accordance with the following equations:

$$C=1-2.8/(3.3+W); \text{ and}$$

$$TM=T*C.$$

19. A thermal printer apparatus according to claim 18; wherein the sub-pulse width TS is determined as the smaller value determined by the following equations:

$$TS=T*K; \text{ and}$$

$$TS=T*(1-C)$$

wherein K is a pulse rate set within the range of 0.1 to 0.3, and the sub-pulse width TS is set such that a total pulse width of the main pulse TM and the sub-pulse TS does not exceed the maximum energizing pulse width T.

20. In a thermal printer apparatus having a plurality of heating elements arranged in a thermal head, in which an energizing pulse is applied to the respective heating elements in accordance with a printing signal to energize the heating elements to perform a printing operation by printing on a print paper, the thermal printer apparatus comprising:

a temperature measuring circuit for measuring a temperature of the thermal head;

a head voltage detector for measuring a voltage applied to the thermal head; and a central processing unit for calculating a maximum energizing pulse width T based upon the measured temperature of the thermal head and the measured voltage applied thereto, for calculating a main pulse width TM based on the maximum energizing pulse width T and a printing speed W, for calculating a sub-pulse width TS as a preselected ratio of the maximum energizing pulse width TM, and for outputting to the thermal head for the printing of one dot on a current line an energizing pulse for driving the thermal head, the energizing pulse having a pulse width selected as the smaller one of a summed pulse width of each an energizing pulse having the calculated sub-pulse width and comprising an energizing pulse corresponding to print dot data for the current line prepared from a logical multiplication of inverted print dot data of a. preceding line, and an energizing pulse having the calculated main pulse width TM and comprising an energizing pulse corresponding to print dot data of the current line, and the pulse width of the maximum energizing pulse T.

21. A thermal printer apparatus according to claim 20; wherein the central processing unit comprises a maximum energizing pulse width calculating circuit for calculating the maximum energizing pulse width T based upon the measured temperature of the thermal head and the measured voltage applied thereto; an energizing pulse width calculating circuit for calculating the main pulse width TM based on the maximum energizing pulse width T and the printing speed W and for calculating the sub-pulse width TS as the preselected ratio of the maximum energizing pulse; and an output circuit for outputting to the thermal head the energizing pulse for driving the thermal head for the printing of one dot on the current line and having the pulse width selected as the smaller one of the summed pulse width of each an energizing pulse having the calculated sub-pulse width and comprising an energizing pulse corresponding to print dot data for the current line prepared from a logical multiplication of inverted print dot data of the preceding line, and an energizing pulse having the calculated main pulse width TM and comprising an energizing pulse corresponding to print dot data of the current line, and the pulse width of the maximum energizing pulse T.

22. A thermal printer apparatus according to claim 21; wherein the energizing pulse width calculating circuit calculates the sub-pulse width TS by multiplying the maximum energizing pulse width T by a predetermined coefficient "K".

23. A thermal printer apparatus according to claim 22; wherein the coefficient "K" is selected as a value within the range of 0.1 and 0.3.

24. A thermal printer apparatus according to claim 20; wherein the sub-pulse is not applied to the heating elements which are to be energized in the current line and which were energized in the immediately preceding line.

25. A thermal printer apparatus according to claim 20; wherein the temperature measuring circuit comprises a thermistor for producing an output voltage according to the temperature of the thermal head and the central processing unit for calculating the temperature of the thermal head in accordance with the output voltage of the thermistor; and the head voltage detector comprises a voltage dividing circuit for producing a divided voltage having a value depending upon a voltage applied to the thermal head and the central processing unit for determining the voltage applied to the thermal head in accordance with the divided voltage.

26. A thermal printer apparatus according to claim 20; wherein the thermal head further comprises a shift register for storing print data; a latch register for latching the print data from the shift register; and an output driver for driving the heating elements by producing the energizing pulses in accordance with the print data.

27. A thermal printer apparatus according to claim 20; wherein the thermal head contains 448 heating elements.

28. A thermal printer apparatus according to claim 20; wherein the main pulse width TM is determined in accordance with the following equations:

$$C=1-2.8/(3.3+W); \text{ and}$$

$$TM=T*C$$

wherein C is a pulse rate.

29. A thermal printer apparatus according to claim 28; wherein the sub-pulse width TS is determined as the smaller value determined by the following equations:

$$TS=T*K; \text{ and}$$

$$TS=T*(1-C)$$

wherein K is a value set within the range of 0.1 to 0.3, and the sub-pulse width TS is set such that a total pulse width of the main pulse TM and the sub-pulse TS does not exceed the maximum energizing pulse width T.

* * * * *